US011354945B2

(12) United States Patent
Piewek et al.

(10) Patent No.: US 11,354,945 B2
(45) Date of Patent: Jun. 7, 2022

(54) DIAGNOSTIC METHOD, DIAGNOSTIC SYSTEM AND MOTOR VEHICLE

(71) Applicant: VOLKSWAGEN AKTIENGESELLSCHAFT, Wolfsburg (DE)

(72) Inventors: Jan Piewek, Magdeburg (DE); Konstantin Jonas, Berlin (DE); Fabian Kai-Dietrich Noering, Wolfenbuettel (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 268 days.

(21) Appl. No.: 16/551,433

(22) Filed: Aug. 26, 2019

(65) Prior Publication Data

US 2020/0074770 A1 Mar. 5, 2020

(30) Foreign Application Priority Data

Aug. 31, 2018 (DE) ..... 10 2018 121 270.4

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01)

(58) Field of Classification Search
CPC .... G07C 5/0808; G07C 5/008; G07C 5/0841; G01M 17/007; G01M 15/04
See application file for complete search history.

(56) References Cited

U.S. PATENT DOCUMENTS

| | | | | |
|---|---|---|---|---|
| 9,678,845 | B2 | 6/2017 | Suzuki et al. | |
| 10,036,335 | B2 | 7/2018 | Banerjee et al. | |
| 2007/0276559 | A1* | 11/2007 | Misawa | G07C 5/008 701/33.8 |
| 2008/0134789 | A1* | 6/2008 | Schneider | F02D 41/22 73/587 |
| 2012/0111089 | A1 | 5/2012 | Martin | |
| 2013/0184929 | A1 | 7/2013 | Salman et al. | |
| 2013/0218522 | A1 | 8/2013 | Suzuki et al. | |
| 2014/0285212 | A1 | 9/2014 | Amoussouga et al. | |

FOREIGN PATENT DOCUMENTS

| | | | |
|---|---|---|---|
| CN | 102395478 | A | 3/2012 |
| CN | 103180793 | A | 6/2013 |
| CN | 103207087 | A | 7/2013 |
| CN | 103383312 | A | 11/2013 |
| CN | 103814202 | A | 5/2014 |
| CN | 105004526 | A | 10/2015 |

(Continued)

OTHER PUBLICATIONS

Search report for German Patent Application No. 10 2018 121 270.4, dated Apr. 8, 2019.

(Continued)

*Primary Examiner* — Michael V Kerrigan
(74) *Attorney, Agent, or Firm* — Pearl Cohen Zedek Latzer Baratz LLP

(57) ABSTRACT

The invention relates to a method for providing a diagnosis of at least one technical system (1) of a motor vehicle (2). The invention further relates to a diagnostic system (10) and a motor vehicle (2).

10 Claims, 5 Drawing Sheets

(56) References Cited

FOREIGN PATENT DOCUMENTS

| | | | |
|---|---|---|---|
| CN | 107 238 500 | A | 10/2017 |
| DE | 10 2014 210 504 | A1 | 12/2014 |
| EP | 2 339 318 | A1 | 6/2011 |
| WO | WO 2017/041930 | A1 | 3/2017 |
| WO | WO 2017/081659 | A1 | 5/2017 |

OTHER PUBLICATIONS

Office Action for Chinese Patent Application No. 201910800459.2, dated Feb. 19, 2021.

* cited by examiner

DIAGNOSTIC METHOD, DIAGNOSTIC SYSTEM AND MOTOR VEHICLE

CROSS-REFERENCE TO RELATED APPLICATIONS

This application claims priority from German Patent Application No. 10 2018 121 270.4, filed Aug. 31, 2018, which is hereby incorporated by reference in its entirety.

FIELD OF THE INVENTION

The present invention relates to a method for providing a diagnosis of at least one technical system of a motor vehicle. The invention further relates to a diagnostic system for a motor vehicle for providing a diagnosis of at least one technical system of the motor vehicle, and a motor vehicle having a generic diagnostic system.

BACKGROUND OF THE INVENTION

Current motor vehicles have numerous different technical systems, for example a power electronics system for supplying power, drive systems, and the like. For monitoring, controlling, and regulating the technical systems and operating states of the motor vehicle, such as engine speed, acceleration, a gear selection, or the like, motor vehicles have sensors that are designed to determine various system parameters.

In conventional motor vehicles, a diagnosis is carried out, for example, by adopting a diagnostic point in a targeted manner. At the diagnostic point the motor vehicle has a plurality of different system parameters that may be compared to corresponding reference parameters by means of a diagnostic device. If a system parameter at the diagnostic point differs from the reference parameter by more than a fixed tolerance, an error is diagnosed by the diagnostic device.

A diagnostic method for monitoring machines is known from U.S. Pat. No. 9,678,845 B2, in which the diagnosis takes place over a period of time in which system parameters are continuously determined. The determined system parameters are compared to reference parameters, and an error is diagnosed for deviations above a tolerance value. WO 2017/081659 A1 relates to a diagnostic method in which a reference frequency is initially determined and is subsequently compared to a diagnostic frequency. Here as well, measuring data obtained over a period of time are used and compared to one another.

Known systems and methods for providing a diagnosis of at least one technical system have the disadvantage that when multiple system parameters are monitored, a very high data volume often results which can quickly overload a diagnostic device. The result may in particular be faulty diagnoses. In addition, there are often interactions between various system parameters, which in many cases cannot be adequately detected, if at all. This may also easily result in faulty diagnoses. Another disadvantage of the known methods is the specific diagnostic mode that must be adopted for the diagnosis, but which during operation does not correspond to the driver intent, i.e., is seldom achievable, if at all.

SUMMARY OF THE INVENTION

The object of the present invention, therefore, is to eliminate or at least partially eliminate the above-described disadvantages in a method for providing a diagnosis of at least one technical system of a motor vehicle, a diagnostic system for a motor vehicle for providing a diagnosis of at least one technical system of the motor vehicle, and a motor vehicle having a diagnostic system. In particular it is the object of the present invention to provide a method, a diagnostic system, and a motor vehicle which in a simple and cost-effective manner ensure a reliable diagnosis of at least one technical system and/or avoid an excessive data volume in the monitoring of system parameters.

The above object is achieved by the patent claims. Accordingly, the object is achieved by a method for providing a diagnosis of at least one technical system of a motor vehicle, having the features of independent Claim 1, by a diagnostic system for a motor vehicle for providing a diagnosis of at least one technical system of the motor vehicle, having the features of independent Claim 9, and by a motor vehicle having the features of independent Claim 10. Further features and details of the invention result from the subclaims, the description, and the drawings. Of course, features and details that are described in conjunction with the method according to the invention also apply in conjunction with the diagnostic system according to the invention as well as the motor vehicle according to the invention, and in each case vice versa, so that with regard to the disclosure, mutual reference is or may always be made to the individual aspects of the invention.

According to a first aspect of the invention, the object is achieved by a method for providing a diagnosis of at least one technical system of a motor vehicle. The method has the following steps:

- determining a first system parameter progression of a first system parameter of the motor vehicle over a first time period by means of a diagnostic device of the motor vehicle,
- determining a third system parameter progression of a third system parameter of the technical system over the first time period by means of the diagnostic system,
- comparing the first system parameter progression to a first reference parameter progression of the first system parameter by means of the diagnostic device,
- determining the presence of an operating situation similarity by means of the diagnostic device when the comparison shows that a deviation of the first system parameter progression from the first reference parameter progression is within a first tolerance,
- comparing the third system parameter progression to a third reference parameter progression of the third system parameter by means of the diagnostic device when the operating situation similarity is determined, and
- determining the presence of a system error by means of the diagnostic device when the comparison shows that a deviation of the third system parameter progression from the third reference parameter progression is outside a third tolerance.

The method according to the invention is used to provide a diagnosis of a technical system of a motor vehicle, in particular an engine, a clutch, a brake, a driver assistance system, a battery, a power electronics system, or the like. The method according to the invention is provided for use in a motor vehicle. However, use of the method in a technical device of any type, in particular in a ship, an aircraft, a machining tool, a conveying machine, or the like is possible and intended according to the invention. The diagnosis should, for example, provide qualitative information concerning whether the technical system under examination is functioning properly, has signs of wear, or is defective. According to the invention, the diagnosis may also be carried out in such a way that quantitative information concerning a state of a technical system of the motor vehicle may be obtained.

By use of the diagnostic device, the first system parameter progression of the first system parameter of the motor vehicle, in particular the technical system, is determined over the first time period. Within the scope of the invention, a determination of the first system parameter progression may also be provided over a period of time that exceeds the first time period, wherein the determination of the first system parameter progression takes place at least over the first time period. The determination preferably takes place during driving operation of the motor vehicle. As the first system parameter, a system parameter is preferably selected that is in an operational relationship with the third system parameter, i.e., the system parameter on which the diagnosis is based. This means that there is a dependency of a value of the third system parameter on a value of the first system parameter. Furthermore, as the first system parameter, a system parameter is preferably selected that can be reliably and accurately determined, and that is preferably independent of a state of wear of the motor vehicle. The determination may take place, for example, by computation, model formation, or by use of a first sensor. When a first sensor is used, the first system parameter progression is preferably transmitted to the diagnostic device in real time, in particular via a wireless or wired connection.

By use of the diagnostic device, the third system parameter progression of the third system parameter of the technical system is determined over the first time period. Within the scope of the invention, a determination of the third system parameter progression may also be provided over a period of time that exceeds the first time period, wherein the determination of the third system parameter progression takes place at least over the first time period. The determination preferably takes place during driving operation of the motor vehicle. As the third system parameter, a system parameter is selected that is to be monitored by means of the diagnostic system. Monitoring is understood in particular to mean monitoring with regard to wear and other defects. The determination may take place, for example, by computation, model formation, or by use of a third sensor. When a third sensor is used, the first system parameter progression is preferably transmitted to the diagnostic device in real time, in particular via a wireless or wired connection. In addition, it may be provided according to the invention that multiple third system parameters of different technical systems are monitored simultaneously or in parallel by means of the method according to the invention.

By use of the diagnostic device, the first system parameter progression is compared to the first reference parameter progression of the first system parameter. The first reference parameter progression is a predefined first system parameter progression. The first reference parameter progression is preferably determined in such a way that it describes an operating state that occurs particularly regularly or frequently during operation of the motor vehicle, for example acceleration from a standstill to 50 km/h, deceleration from 30 km/h to a standstill, a standard charging operation of a vehicle battery with common charging parameters, or the like. The first tolerance is preferably predefined.

The comparison has in particular two possible results. When a deviation of the first system parameter progression from the first reference parameter progression is within the first tolerance, an operating situation similarity is present. For the case that the deviation of the first system parameter progression from the first reference parameter progression is outside the first tolerance, no operating situation similarity is present. The diagnostic device is designed to determine, based on the comparison, the presence of an operating situation similarity when the above-mentioned condition necessary for this purpose is met. According to the method according to the invention, the diagnostic device determines the operating situation similarity for the first time period when the condition is met. This determination may be made qualitatively and/or quantitatively.

Operating situation similarity also means that the third reference parameter progression is usable as a reference for checking the third system parameter progression. Thus, for a determined operating situation similarity, according to the invention the third system parameter progression is compared to the third reference parameter progression of the third system parameter by means of the diagnostic device. The third reference parameter progression is a predefined third system parameter progression. The third reference parameter progression is dependent on the first reference parameter progression and the second reference parameter progression.

When the comparison by the diagnostic device shows that a deviation of the third system parameter progression from the third reference parameter progression is outside the third tolerance, the diagnostic device determines the presence of a system error of the technical system of the motor vehicle involving the third system parameter. The system error may in particular be qualitatively determined. The diagnostic device preferably determines the system error quantitatively, for example on a percentage basis.

A method according to the invention for providing a diagnosis of at least one technical system of a motor vehicle has the advantage over conventional methods that a targeted diagnosis of a technical system may be carried out over a period of time in a cost-effective manner, using simple means. Due to the targeted identification of the first time period, in which the operating situation similarity is present, it is possible to make the targeted comparison of the third reference parameter progression, associated with the particular operating situation, to the third system parameter progression that is determined during the first time period. Thus, a diagnosis over time intervals in which no operating situation similarity is present is no longer necessary, so that the data volume and computing time of the diagnostic device may be significantly reduced. Targeted adoption of a diagnostic point or a diagnostic routine, which often does not correspond to an operating state according to a driver intent, is no longer necessary with the method according to the invention, since the operating situation similarity during driving operation may occur, at least temporarily, in the first time interval, and in this first time interval the diagnoses may be reliably carried out based on the third system parameter progression. The consideration of a time period also has the advantage that spontaneously occurring measurement fluctuations may thus be compensated for. System error may thus be determined in a particularly reliable manner.

According to one preferred refinement of the invention, in a method it may be provided that a second system parameter progression of a second system parameter of the motor vehicle is determined over the first time period by means of the diagnostic device, wherein the second system parameter progression is compared to a second reference parameter progression of the second system parameter by means of the diagnostic device, and wherein the presence of the operating situation similarity is determined only when a deviation of the second system parameter progression from the second reference parameter progression is within a second tolerance. By use of the diagnostic device, the second system parameter progression of the second system parameter of the motor vehicle, in particular the technical system, is determined over the first time period. Within the scope of the invention, a determination of the second system parameter progression may also be provided over a period of time that exceeds the first time period, wherein the determination of the second system parameter progression takes place at least over the first time period. The determination preferably takes place during driving operation of the motor vehicle. As the second system parameter, a system parameter is preferably selected that is in an operational relationship with the third system parameter, i.e., the system parameter on which the diagnosis is based. Accordingly, it is preferred that the value of the third system parameter is dependent on a value pair of the first system parameter and the second system parameter. Furthermore, as the second system parameter, a system parameter is preferably selected that can be reliably and accurately determined, and that is preferably independent of a state of wear of the motor vehicle.

The determination may take place, for example, by computation, model formation, or by use of a second sensor. When a second sensor is used, the first system parameter progression is preferably transmitted to the diagnostic device in real time, in particular via a wireless or wired connection. The second reference parameter progression is a predefined second system parameter progression, and is preferably determined in such a way that it describes an operating state that occurs particularly regularly or frequently during operation of the motor vehicle, for example acceleration from a standstill to 50 km/h, deceleration from 30 km/h to a standstill, a standard charging operation of a vehicle battery with common charging parameters, or the like. The second tolerance is preferably predefined. It may also be provided according to the invention that the second tolerance is determined as a function of a deviation of the first system parameter progression from the first reference parameter progression, in particular in such a way that for a relatively small deviation a relatively low second tolerance is determined. The comparison has in particular two possible results. When a deviation of the first system parameter progression from the first reference parameter progression is within the first tolerance, and a deviation of the second system parameter progression from the second reference parameter progression is within the second tolerance, an operating situation similarity is present. For the case that the deviation of the first system parameter progression from the first reference parameter progression is outside the first tolerance, and/or the deviation of the second system parameter progression from the second reference parameter progression is outside the second tolerance, no operating situation similarity is present. The diagnostic device is designed to determine, based on the comparison, the presence of an operating situation similarity when the above-mentioned condition necessary for this purpose is met. According to the method according to the invention, the diagnostic device determines the operating situation similarity for the first time period when the condition is met. This determination may be made qualitatively and/or quantitatively. This has the advantage that the accuracy of the determination of an operating situation similarity is thus improved. Thus, according to the invention this operation may take place with multiple different second system parameters in order to be able to predict operating situation similarities even more accurately.

It is preferred that an engine speed of an engine of the motor vehicle is used as the first system parameter and a torque of the engine is used as the second system parameter, or that a speed of the motor vehicle is used as the first system parameter and a gear of a transmission of the motor vehicle is used as the second system parameter. Other system parameter combinations of the above-mentioned system parameters may also be selected according to the invention. An operating situation of the motor vehicle may be reliably and easily determined by determining an engine speed and a torque, as well as a speed of the motor vehicle and a selected gear, over the first time period. In addition, these system parameters are essentially independent of wear, so that on this basis, easily reproducible diagnoses may be carried out in a cost-effective manner, using simple means. Alternatively, it is preferred that a current intensity of a battery of the motor vehicle is used as the first system parameter and/or a voltage of the battery of the motor vehicle is used as the second system parameter. Use of these system parameters is advantageous in particular for a diagnosis of the battery, for example for a charging operation. For example, a temperature of the battery may be used as the third system parameter. In this way, wear on the battery may be easily diagnosed in a cost-effective manner, using simple means.

It is also preferred to use a charge pressure or a temperature of an engine or a temperature of a brake or a temperature of a clutch or an air pressure or a temperature of a tire of the motor vehicle as the third system parameter. According to the invention, diagnoses may also be carried out in parallel, using different third system parameters. In this case, third system parameter progressions of different third system parameters are compared to corresponding third reference parameter progressions in parallel. By use of such third system parameters, states, in particular states of wear, of the engine, battery, brake, clutch, or tires may be determined in a cost-effective manner, using simple means.

In one particularly preferred embodiment, in an initial method step the motor vehicle is operated in a reference time interval with the first reference parameter progression and the second reference parameter progression, wherein the third reference parameter progression is determined during the reference time interval by means of the third sensor. The initial method step is used to determine the reference parameter progressions. In this regard, operating locations of the motor vehicle are preferably taken into account at which parameters such as air pressure, temperature, humidity, dust levels, regional fuel quality, or the like, which are able to influence the operating behavior of motor vehicles are known or may be controlled. The determined reference parameter progressions are preferably stored in a memory device in the motor vehicle and/or on a server or in a cloud. A specific operating situation is determined via the first reference parameter progression and the second reference parameter progression. For this operating situation, the associated third reference parameter progression or the associated third reference parameter progressions is/are determined, in particular by measurement. To determine third reference parameter progressions that are as representative and reliable as possible, it is preferably ensured beforehand that the technical systems involved are functioning properly or have at least one instance of defined or algorithmically detectable damage or wear. An initial method step has the advantage that the diagnostic system may be individually set or calibrated to a certain motor vehicle. Diagnostic results may thus be improved in a cost-effective manner, using simple means.

In one alternative embodiment of the method according to the invention, the third reference parameter progression is obtained from the motor vehicle from a separate database. This may take place, for example, via a wireless data link to the database or to neighboring vehicles. The database contains the reference parameter progressions, for example, as expert data from the manufacturer and/or a repair shop. Additionally or alternatively, it may be provided that the database contains reference parameter progressions from crowdsourced data, in particular from motor vehicles of the same type. Crowdsourced data are preferably prepared using conventional methods for forming average values. In addition, operating locations of the motor vehicles are preferably taken into account in which parameters, such as air pressure, temperature, humidity, dust levels, regional fuel quality, or the like, which are able to influence the operating behavior of motor vehicles are known or may be controlled. A separate database has the advantage that a large number of reliable reference data progressions are provided in a cost-effective manner, using simple means.

According to one preferred embodiment of the invention, the comparison of the first system parameter progression to the first reference parameter progression, and/or of the second system parameter progression to the second reference parameter progression, and/or of the third system parameter progression to the third reference parameter progression, takes place by means of dynamic time warping, a Smith-Waterman algorithm, in particular a Smith-Waterman algorithm enhanced with dynamic time warping, and/or a multidimensional Euclidean distance and/or a cross-correlation and/or a multidimensional tube definition, and/or a combination of these or other methods, over the first time period. Such mathematical methods are well known and particularly suited for determining similarities and deviations of parameter progressions in a cost-effective manner, using simple means.

It is particularly preferred to dynamically determine the third tolerance as a function of the deviation of the first system parameter progression from the first reference parameter progression within the first tolerance, and/or as a function of the deviation of the second system parameter progression from the second reference parameter progression within the second tolerance, in such a way that the third tolerance is larger for a large deviation than for a small deviation. When there is a relatively large deviation between the first system parameter progression and the first reference parameter progression and/or between the second system parameter progression and the second reference parameter progression, this means that the operating situations are relatively dissimilar. For smaller deviations, the operating situations are more similar, and without deviations are identical. In other words, a degree of similarity of the operating situations is determinable. By establishing a relationship between the degree of similarity of the operating situations and the third tolerance, the quality of the diagnosis may be improved in a cost-effective manner, using simple means. This is because when there is a high degree of similarity of the operating situations, smaller deviations of the third system parameter progression from the third reference parameter progression result for a diagnosis of a system error than is the case with a lesser degree of similarity. In addition, in particular when there is a low degree of similarity, incorrectly diagnosed system errors may thus be avoided.

According to a second aspect of the invention, the object is achieved by a diagnostic system for a motor vehicle for providing a diagnosis of at least one technical system of the motor vehicle. The diagnostic system has a first sensor for determining a first system parameter progression of a first system parameter of the motor vehicle, in particular the technical system, over a first time period, a second sensor for determining a second system parameter progression of a second system parameter of the motor vehicle, in particular the technical system, over the first time period, a third sensor for determining a third system parameter progression of a third system parameter of the technical system over the first time period, a diagnostic device for comparing system parameter progressions to reference parameter progressions and for determining the presence of system errors based on the comparison, and a memory device for storing reference parameter progressions. According to the invention, the diagnostic system is designed for carrying out a method according to the invention.

The diagnostic system may, for example, be an integral part of an engine control device. All advantages that have already been described for a method according to the first aspect of the invention result with the described diagnostic system. Accordingly, the diagnostic system according to the invention has the advantage over conventional diagnostic systems that a targeted diagnosis of a technical system may be carried out over a period of time in a cost-effective manner, using simple means. Due to a targeted identification of the first time period, in which the operating situation similarity is present, it is possible to make the targeted comparison of the third reference parameter progression, associated with the particular operating situation, to the third system parameter progression that is determinable during the first time period. Thus, a diagnosis over time intervals in which no operating situation similarity is present is no longer necessary, so that the data volume and computing time of the diagnostic device may be significantly reduced. Targeted adoption of a diagnostic point is no longer necessary with the diagnostic system according to the invention, since the operating situation similarity during driving operation may occur, at least temporarily, in the first time interval, and in this first time interval the diagnoses may be reliably carried out based on the third system parameter progression. The option for considering a time period also has the advantage that spontaneously occurring measurement fluctuations may thus be compensated for. System error may thus be determined in a particularly reliable manner.

According to a third aspect of the invention, the object is achieved by a motor vehicle. The motor vehicle has an engine and a diagnostic system according to the invention for providing a diagnosis of at least one technical system of the motor vehicle.

All advantages that have already been described for a method according to the first aspect of the invention and a diagnostic system according to the second aspect of the invention result with the described motor vehicle. Accordingly, the motor vehicle according to the invention has the advantage over conventional motor vehicles that a targeted diagnosis of a technical system may be carried out over a period of time in a cost-effective manner, using simple means. Due to a targeted identification of the first time period, in which the operating situation similarity is present, it is possible to make the targeted comparison of the third reference parameter progression, associated with the particular operating situation, to the third system parameter progression that is determinable during the first time period. Thus, a diagnosis over time intervals in which no operating situation similarity is present is no longer necessary, so that the data volume and computing time of the diagnostic device may be significantly reduced. Targeted adoption of a diagnostic point, using the diagnostic system according to the invention, is no longer necessary with the motor vehicle according to the invention, since the operating situation similarity during driving operation may occur, at least temporarily, in the first time interval, and in this first time interval the diagnoses may be reliably carried out based on the third system parameter progression. The option for considering a time period also has the advantage that spontaneously occurring measurement fluctuations may thus be compensated for. System error may thus be determined in a particularly reliable manner.

BRIEF DESCRIPTION OF THE DRAWINGS

A method according to the invention, a diagnostic system according to the invention, and a motor vehicle according to the invention are explained in greater detail below with reference to the drawings, which schematically show the following.

Elements having the same function and operating principle are provided with the same reference symbols in FIGS. 1 through 5.

DETAILED DESCRIPTION OF THE INVENTION

Figure 1:
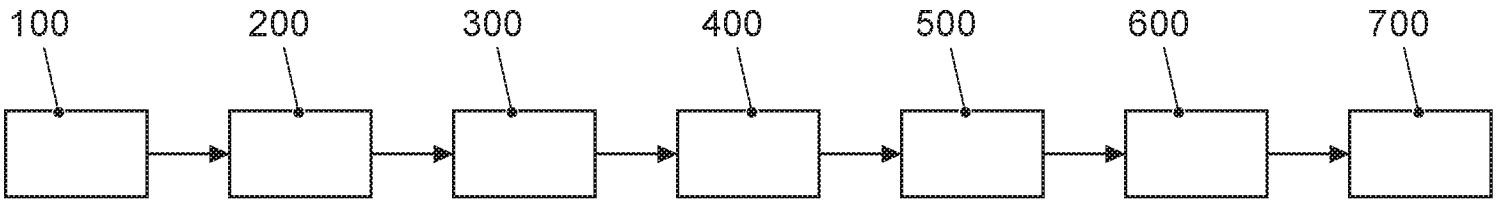
FIG. 1 shows a flow chart of one preferred embodiment of a method according to the invention.

FIG. 1 schematically illustrates one preferred embodiment of a method according to the invention in a flow chart. In a first method step 100, a first system parameter progression V1 of a first system parameter S1 of a motor vehicle 2 (see FIG. 5) is determined over a first time period T by means of a first sensor 3 (see FIG. 5). The determination may take place continuously or intermittently, for example. It may also be provided that the determination takes place over a longer period of time than the first time period T, in particular over the entire operating period or a time during which the motor vehicle 2 is in motion. In a second method step 200, a second system parameter progression V2 of a second system parameter S2 of the motor vehicle 2 is determined over the first time period T by means of a second sensor 4 (see FIG. 5). The determination may take place continuously or intermittently, for example. It may also be provided that the determination takes place over a longer period of time than the first time period T, in particular over the entire operating period or a time during which the motor vehicle 2 is in motion. In a third method step 300, a third system parameter progression V3 of a third system parameter S3 of the motor vehicle 2 is determined over the first time period T by means of a third sensor 5 (see FIG. 5). The determination may take place continuously or intermittently, for example. It may also be provided that the determination takes place over a longer period of time than the first time period T, in particular over the entire operating period or a time during which the motor vehicle 2 is in motion.

In a fourth method step 400, the first system parameter progression V1 is compared to a first reference parameter progression R1 of the first system parameter S1 by means of a diagnostic device 6 (see FIG. 5) of a diagnostic system 10 (see FIG. 5) of the motor vehicle 2. The second system parameter progression V2 is compared to a second reference parameter progression R2 of the second system parameter S2, likewise by means of the diagnostic device 6. In a fifth method step 500, the presence of an operating situation similarity is determined by means of the diagnostic device 6 when the comparison shows that a deviation of the first system parameter progression V1 from the first reference parameter progression R1 is within a first tolerance, and a deviation of the second system parameter progression V2 from the second reference parameter progression R2 is within a second tolerance. In a sixth method step 600, the third system parameter progression V3 is compared to a third reference parameter progression R3 of the third system parameter S3 by means of the diagnostic device 6. Lastly, in a seventh method step 700 the presence of a system error is determined by means of the diagnostic device 6 when the comparison shows that a deviation of the third system parameter progression V3 from the third reference parameter progression R3 is outside a third tolerance.

Figure 2:
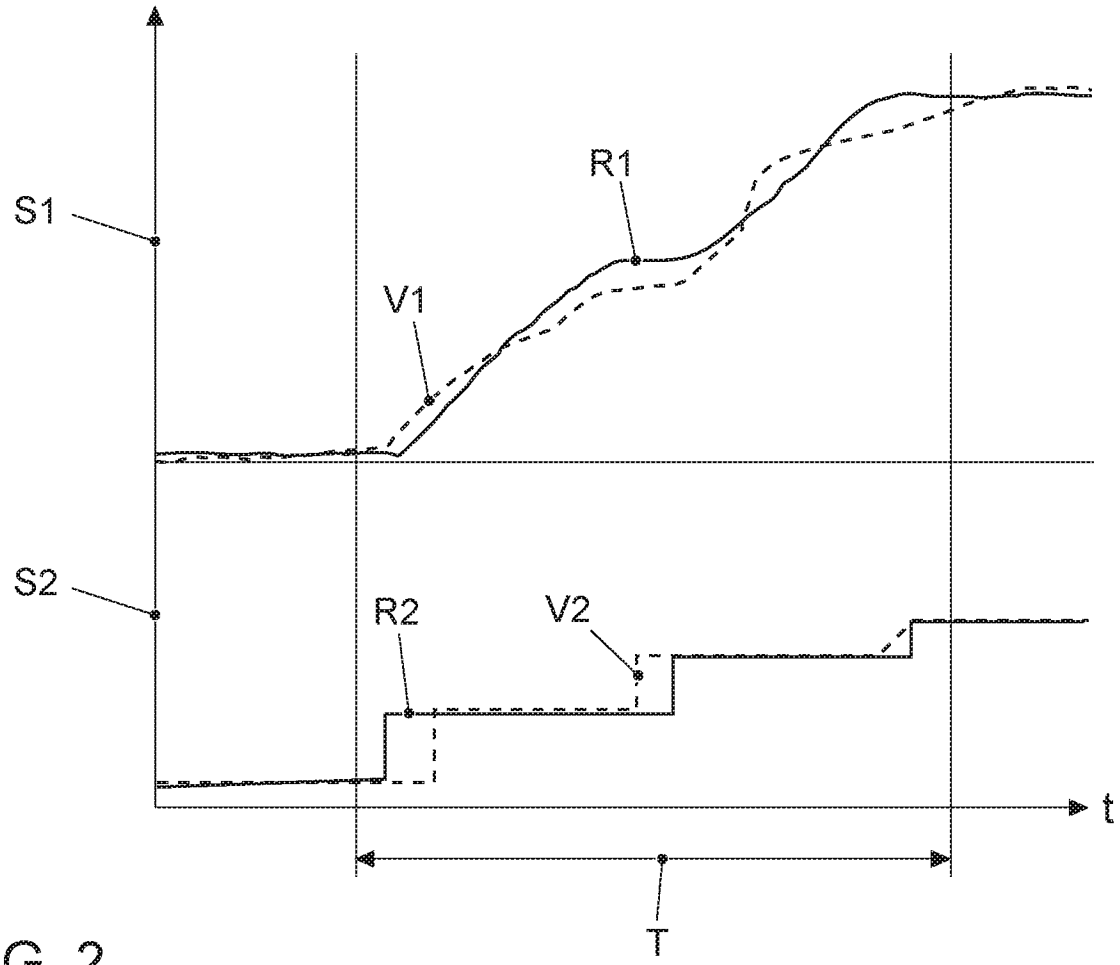
FIG. 2 shows a diagram of a comparison of a first system parameter progression to a first reference parameter progression, and of a second system parameter progression to a second reference parameter progression, over a first time period.

FIG. 2 shows a schematic diagram of a comparison of a first system parameter progression V1 of a first system parameter S1 to a first reference parameter progression R1, and of a second system parameter progression V2 of a second system parameter S2 to a second reference parameter progression R2, over a first time period T. In this example, the first system parameter progression V1 in the first time period T corresponds to the first reference parameter progression R1 within a first tolerance. In addition, the second system parameter progression V2 in the first time period T corresponds to the second reference parameter progression R2 within a second tolerance. Accordingly, an operating situation similarity is present.

Figure 3:
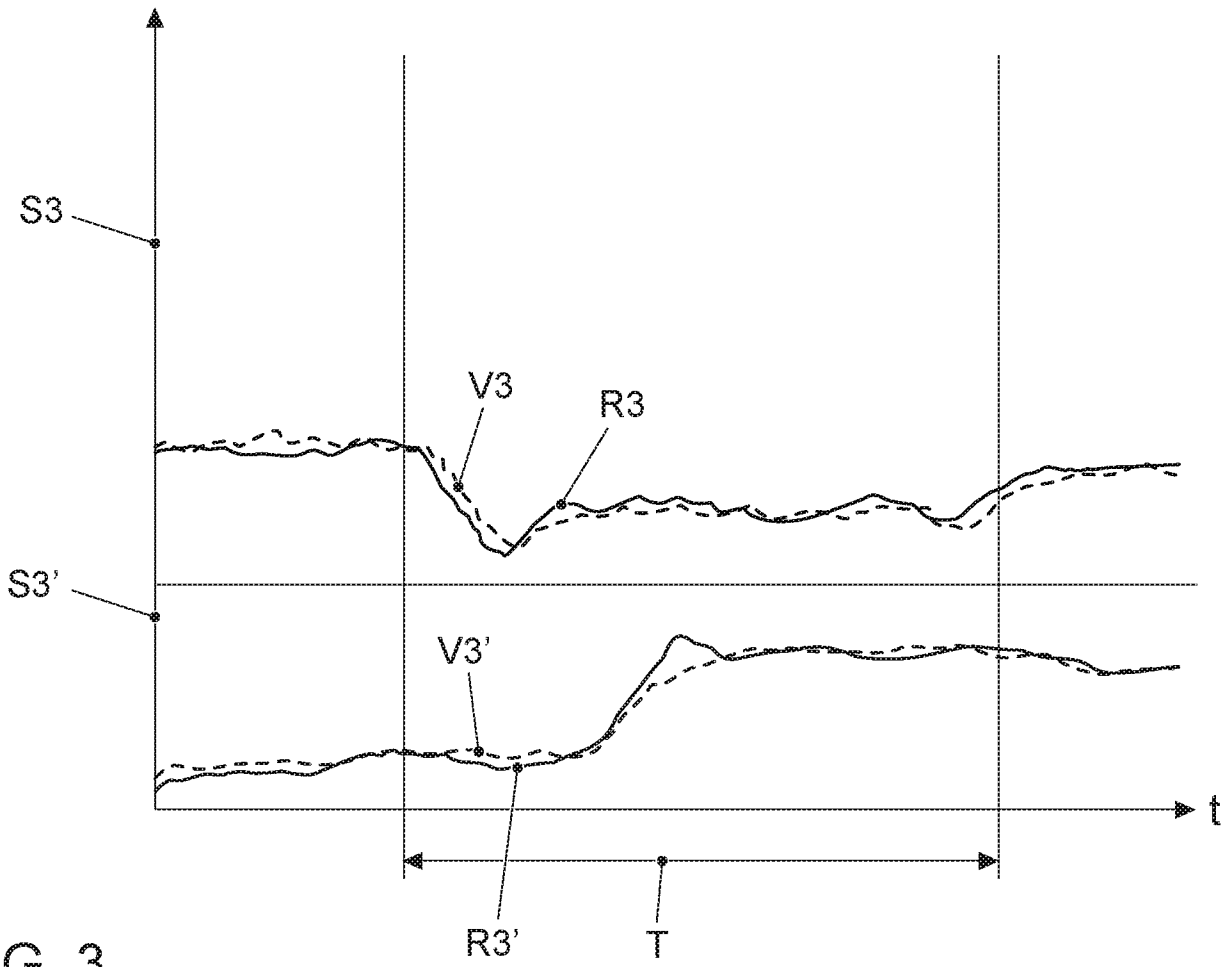
FIG. 3 shows a diagram of a first comparison of third system parameter progressions to third reference parameter progressions over the first time period.

FIG. 3 is based on the operating similarity present in FIG. 2. FIG. 3 shows a schematic diagram of a first comparison of a third system parameter progression V3 to a third reference parameter progression R3 over the first time period T. In addition, FIG. 3 shows a first comparison of an alternative third system parameter progression V3' to an alternative third reference parameter progression R3' over the first time period T. The third system parameter progression V3 deviates from the third reference parameter progression R3 within the third tolerance. Likewise, the alternative third system parameter progression V3' deviates from the alternative third reference parameter progression R3' within the third tolerance. Accordingly, no system error is present.

Figure 4:
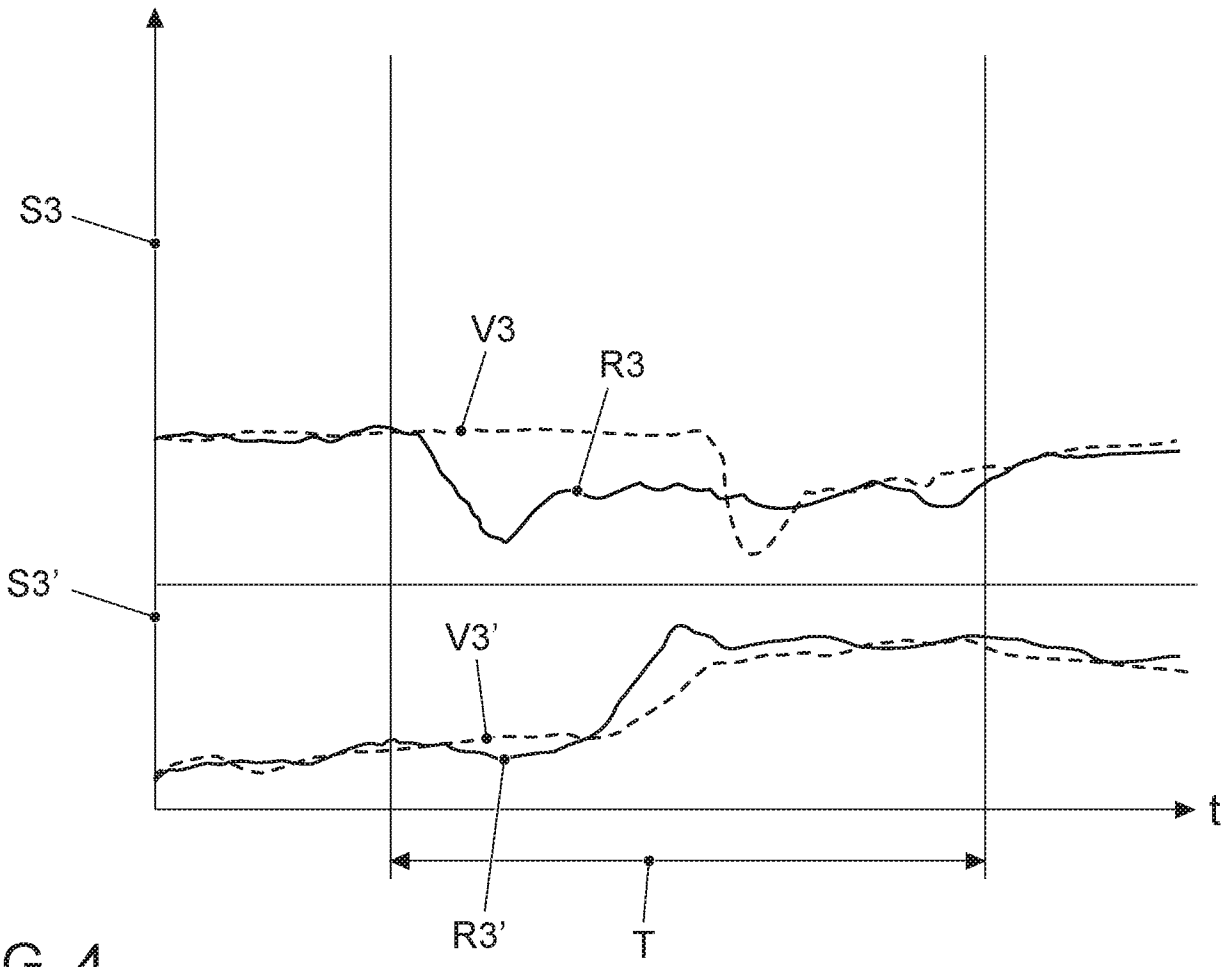
FIG. 4 shows a diagram of a second comparison of third system parameter progressions to third reference parameter progressions over the first time period.

FIG. 4 is based on the operating similarity present in FIG. 2. FIG. 4 shows a schematic diagram of a second comparison of a third system parameter progression V3 to a third reference parameter progression R3 over the first time period T. In addition, FIG. 3 [sic; 4] shows a second comparison of an alternative third system parameter progression V3' to an alternative third reference parameter progression R3' over the first time period T. The deviation of the third system parameter progression V3 from the third reference parameter progression R3 is farther outside the third tolerance, in particular in the first half of the first time period T. Accordingly, a system error is present.

Figure 5:
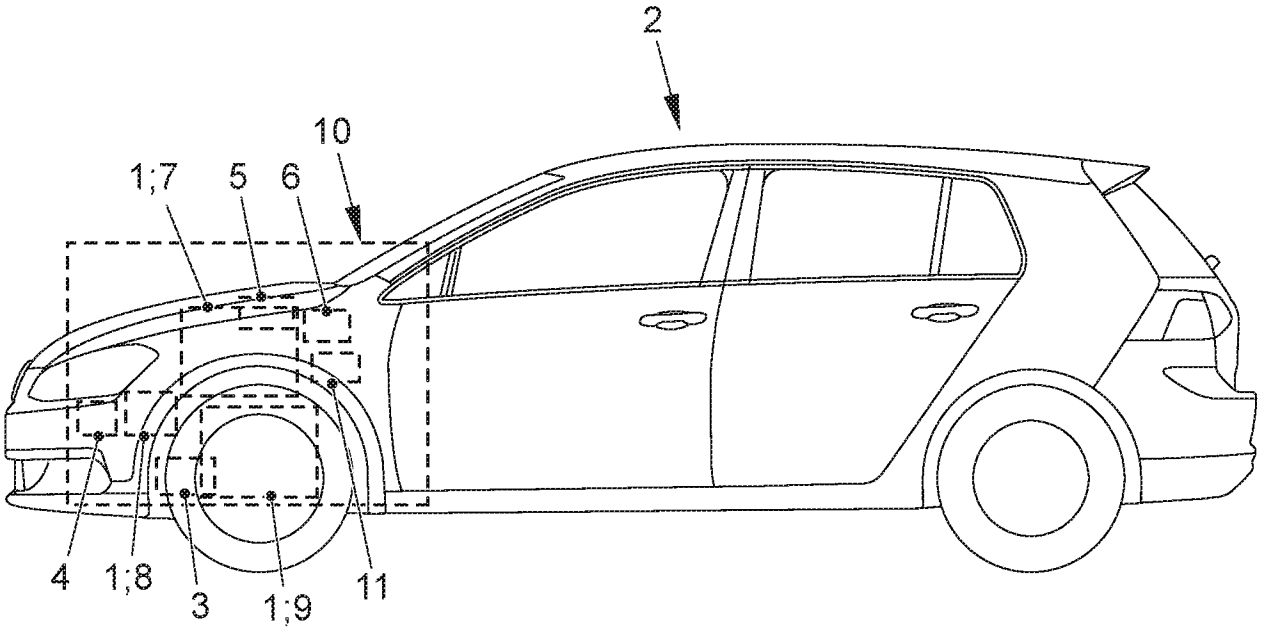
FIG. 5 shows a side view of one preferred embodiment of a motor vehicle according to the invention.

FIG. 5 schematically shows one preferred embodiment of a motor vehicle 2 according to the invention in a side view. The motor vehicle 2 has multiple technical systems 1, for example an engine 7, a transmission 8, and a brake 9. In addition, the motor vehicle 2 has a diagnostic system 10 according to the invention with a first sensor 3, a second sensor 4, a third sensor 5, a diagnostic device 6, and a memory device 11, in particular for storing reference parameter progressions. The first sensor 3 is designed, for example, as a rotational speed sensor for determining a wheel speed of a wheel of the motor vehicle. The second sensor 4 is designed, for example, for determining a gear selection of the transmission 8. The third sensor 5 is designed, for example, for determining a temperature of the engine 7.

LIST OF REFERENCE SYMBOLS

1 technical system
2 motor vehicle
3 first sensor
4 second sensor
5 third sensor
6 diagnostic device
7 engine
8 transmission
9 brake
10 diagnostic system
11 memory device
100 first method step
200 second method step
300 third method step
400 fourth method step
500 fifth method step
600 sixth method step
700 seventh method step
R1 first reference parameter progression
R2 second reference parameter progression
R3 third reference parameter progression
R3' alternative third reference parameter progression
S1 first system parameter
S2 second system parameter
S3 third system parameter
S3' alternative third system parameter
T first time period
V1 first system parameter progression
V2 second system parameter progression
V3 third system parameter progression
V3' alternative third system parameter progression

The invention claimed is:

1. A method for providing a diagnosis of at least one technical system of a motor vehicle, having the following steps:

determining a first system parameter progression of a first system parameter of the motor vehicle over a first time period by means of a diagnostic device of the motor vehicle, determining a third system parameter progression of a third system parameter of the at least one technical system over the first time period by the diagnostic device, comparing, in a first comparison, the first system parameter progression to a first reference parameter progression of the first system parameter by the diagnostic device, determining the presence of an operating situation similarity by the diagnostic device when the first comparison shows that a deviation of the first system parameter progression from the first reference parameter progression is within a first tolerance, comparing, in a third comparison, the third system parameter progression to a third reference parameter progression of the third system parameter by the diagnostic device only when the operating situation similarity is determined, and determining the presence of a system error by the diagnostic device when the third comparison shows that a deviation of the third system parameter progression from the third reference parameter progression is outside a third tolerance.

2. The method according to claim 1, further comprising:

determining a second system parameter progression of a second system parameter of the motor vehicle over the first time period by the diagnostic device, comparing, in a second comparison, the second system parameter progression to a second reference parameter progression of the second system parameter by the diagnostic device, and determining the presence of the operating situation similarity only when a deviation of the second system parameter progression from the second reference parameter progression is within a second tolerance.

3. The method according to claim 2, wherein:

an engine speed of an engine of the motor vehicle is used as the first system parameter, and a torque of the engine is used as the second system parameter, or a speed of the motor vehicle is used as the first system parameter, and a gear of a transmission of the motor vehicle is used as the second system parameter, or a current of a battery of the motor vehicle is used as the first system parameter, and/or a voltage of the battery of the motor vehicle is used as the second system parameter.

4. The method according to claim 2, further comprising, in an initial method step, operating the motor vehicle in a reference time interval with the first reference parameter progression and the second reference parameter progression, wherein the third reference parameter progression is determined during the reference time interval by a third sensor.

5. The method according to claim 2, wherein comparing the first system parameter progression to the first reference parameter progression, and/or comparing the second system parameter progression to the second reference parameter progression, and/or comparing the third system parameter progression to the third reference parameter progression takes place by means of dynamic time warping, a Smith-Waterman algorithm, in particular a Smith-Waterman algorithm enhanced with dynamic time warping, and/or a multidimensional Euclidean distance and/or a cross-correlation and/or a multidimensional tube definition, over the first time period.

6. The method according to claim 2, further comprising: dynamically determining the third tolerance as a function of the deviation of the first system parameter progression from the first reference parameter progression within the first tolerance, and/or of the second system parameter progression from the second reference parameter progression within the second tolerance, in such a way that the third tolerance is larger for a large deviation than for a small deviation.

7. The method according to claim 1, wherein a charge pressure of an engine or a temperature of an engine, or a temperature of a brake, or a temperature of a clutch, or an air pressure of a tire of the motor vehicle, or a temperature of a tire of the motor vehicle is used as the third system parameter.

8. The method according to claim 1, wherein the third reference parameter progression is obtained from the motor vehicle from a separate database.

9. A diagnostic system for a motor vehicle NI for providing a diagnosis of at least one technical system of the motor vehicle, comprising:

a first sensor for determining a first system parameter progression of a first system parameter of the motor vehicle over a first time period, a second sensor for determining a second system parameter progression of a second system parameter of the motor vehicle over the first time period, a third sensor for determining a third system parameter progression of a third system parameter of the at least one technical system over the first time period, a diagnostic device for comparing system parameter progressions to reference parameter progressions and for determining a presence of system errors based on the comparison, and a memory device NI for storing reference parameter progressions, wherein the diagnostic system is designed for carrying out a method according to claim 1.

10. A motor vehicle, comprising:

an engine, and a diagnostic system for providing a diagnosis of at least one technical system of the motor vehicle, wherein the diagnostic system is designed according to claim 9.

* * * * *